US011795756B2

(12) United States Patent
Friezner et al.

(10) Patent No.: US 11,795,756 B2
(45) Date of Patent: Oct. 24, 2023

(54) ADJUSTABLE SHIM ASSEMBLY

(71) Applicants: Denis Friezner, Boise, ID (US); Cory Reisner, Northridge, CA (US)

(72) Inventors: Denis Friezner, Boise, ID (US); Cory Reisner, Northridge, CA (US)

( * ) Notice: Subject to any disclaimer, the term of this patent is extended or adjusted under 35 U.S.C. 154(b) by 0 days.

(21) Appl. No.: 17/701,343

(22) Filed: Mar. 22, 2022

(65) Prior Publication Data

US 2022/0372812 A1 Nov. 24, 2022

Related U.S. Application Data

(60) Provisional application No. 63/190,981, filed on May 20, 2021.

(51) Int. Cl.
*E06B 1/60* (2006.01)

(52) U.S. Cl.
CPC ..... *E06B 1/6069* (2013.01)

(58) Field of Classification Search
CPC ..... E06B 1/6069; E06B 1/08; E04F 13/0853
See application file for complete search history.

(56) References Cited

U.S. PATENT DOCUMENTS 2,651,814 A * 9/1953 Lester, Jr. ..... E06B 1/6069 49/505
2,914,817 A * 12/1959 Jackson ..... E06B 1/52 49/505
3,553,891 A * 1/1971 Casebolt et al. ..... E06B 1/18 52/844
4,135,335 A * 1/1979 Jensen ..... E04G 25/00 248/188.2
4,232,068 A * 11/1980 Hoh ..... E06B 1/6069 428/167
4,679,366 A * 7/1987 Hitchins ..... E04B 2/821 52/800.15
4,713,922 A * 12/1987 Ingold ..... E06B 1/6069 52/656.2
4,731,965 A * 3/1988 Jensen ..... F16B 2/14 52/126.5
5,054,250 A * 10/1991 Foss ..... E06B 1/6069 52/211
5,163,255 A * 11/1992 Gamba ..... B27B 1/00 206/499
5,815,992 A * 10/1998 Wells ..... F16B 19/02 248/649
5,853,838 A * 12/1998 Siems ..... E06B 1/6069 156/247
5,953,862 A * 9/1999 Earhart ..... E04F 13/0853 52/98
6,018,916 A * 2/2000 Henry ..... E06B 1/6069 52/211
6,155,004 A * 12/2000 Earhart ..... E04F 13/0853 52/217
6,230,446 B1 * 5/2001 Chalich ..... E06B 1/6069 52/98
6,517,051 B1 * 2/2003 Cavanaugh ..... B66F 7/243 254/88

(Continued)

FOREIGN PATENT DOCUMENTS

DE 202017000902 U1 * 5/2017

*Primary Examiner* — James M Ference
(74) *Attorney, Agent, or Firm* — James E. Brunton

(57) ABSTRACT

Shims of the character used in building construction to install fixtures such as windows, doors, and the like within rough framed openings.

15 Claims, 9 Drawing Sheets

(56) References Cited

U.S. PATENT DOCUMENTS 6,560,934 B1 * 5/2003 Workman ..... E06B 1/6069 52/204.56
7,108,901 B2 * 9/2006 Traub ..... B29B 9/14 428/167
7,357,364 B2 * 4/2008 Jackson ..... F16B 2/04 411/75
7,703,727 B2 * 4/2010 Selness ..... A47B 91/028 248/188.2
7,716,880 B1 * 5/2010 Shray ..... B29C 45/2628 52/309.1
8,136,308 B2 * 3/2012 Slott ..... E04F 15/02044 52/126.5
8,813,437 B1 * 8/2014 Spofford ..... E06B 1/6069 52/213
9,593,524 B2 * 3/2017 Rasmussen ..... E06B 1/6015
9,791,256 B1 * 10/2017 Beer ..... E04F 21/0015
10,125,533 B1 * 11/2018 Stathis ..... E06B 1/68
2002/0148172 A1 * 10/2002 Deschenes ..... B27M 3/02 52/98
2002/0157328 A1 * 10/2002 Holder ..... E06B 1/6069 52/126.1
2003/0145531 A1 * 8/2003 Holder ..... F16M 7/00 52/98
2006/0254162 A1 * 11/2006 Workman ..... E06B 1/6069 52/213
2007/0166498 A1 * 7/2007 Penar ..... E06B 1/6069 428/40.1
2008/0142655 A1 * 6/2008 Bruhn ..... E04F 21/0015 248/188.2
2009/0044463 A1 * 2/2009 Moscone ..... E06B 1/6069 52/126.1
2009/0246440 A1 * 10/2009 Eagle ..... E06B 1/6069 428/156
2010/0058678 A1 * 3/2010 Lutz ..... E06B 1/6069 52/126.1
2022/0372812 A1 * 11/2022 Friezner ..... E06B 1/6069

* cited by examiner

ADJUSTABLE SHIM ASSEMBLY

CROSS-REFERENCE TO RELATED APPLICATIONS

This is a Non-Provisional Application claiming the benefit of Provisional Application No. 63/190,981 filed May 20, 2021.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

Field of the Invention

The present invention relates generally to shims of the character used in building construction to install fixtures such as windows, doors, and the like within rough framed openings.

Description of Related Art Including Information Disclosed Under 37 CFR 1.97 and 1.98

In prior art building construction practice, rough framed openings are typically provided to accommodate the installation of prefabricated door and window units. It is well understood that the door and window units must be secured within the rough framed openings so that there is a gap between the exterior frame of the window or door and the rough framed opening. The gap surrounding the window or door must be sufficient so that any shifting of the opening frame does not compress the exterior frame of the window or door against the opening frame. In this way, loads that are generated by slight movements in the building frame are transferred around the window or door by way of the gap and do not pass through the window or door. If there were no such gap, a shifting load could compress the opening against the exterior frame of the window or door making it difficult to properly operate the window or door.

It is common in prior art building construction practice to place shims between the exterior frame of an insertable structure such as window or door and the rough framed opening of the building. Typically, the shims are used in pairs wherein each shim has a thick back end and a thin front end, a flat base surface and an opposed sloped contact surface extending between the ends. As a general rule, the gap distance between structural surfaces of the frames is more than one-quarter inch and less than one-half inch. A typical prior art wooden shim is about six to ten inches long, has about a one-sixteenth inch thin leading end and about a three-eighths inch thick back end, and is about one and a quarter inches wide. Such shims were often fabricated by the construction worker on the construction site from scrap materials. However, finding a shim of the appropriate size and shape to achieve the correct spacing is often difficult and time-consuming and if an incorrect shim is used the installed window or door unit will be improperly positioned within the rough framed opening. It is this prior art drawback that the present invention seeks to overcome by providing an easily adjustable shim assembly that can readily be used by relatively unskilled workers to properly install prefabricated window and door units within rough framed openings.

BRIEF SUMMARY OF THE INVENTION

By way of brief summary, the present invention comprises an adjustable shim assembly that includes a base, a fixed wedge connected to the base, the fixed wedge having a downwardly sloping upper surface provided with a multiplicity of spaced apart fixed wedge rails and an adjustable wedge connected to the fixed wedge for movement between a first position and a second position, the adjustable wedge having an upper surface and an upwardly sloping lower surface provided with a multiplicity of spaced apart track like channels configured to encircle and engage the fixed wedge rails.

With the forgoing in mind, it is a primary object of the invention to provide a shim assembly, the thickness of which can be quickly and easily incrementally changed by the worker.

Another object of the invention is to provide a shim assembly of the aforementioned character in which the base of the shim assembly can quickly and easily be extended through the use of a base extension that is slidably connected to the base of the assembly.

Another object of the invention is to provide a shim assembly of the character described in the preceding paragraphs in which the base of the shim assembly includes a mounting surface that is easily accessible by the workman to enable the assembly to be secured to the rough framed opening.

Yet another object of the invention is to provide an apparatus of the character described that is of a unique design and is suitable for use in various types of construction.

Still another object of the invention is to provide an apparatus as described in the preceding paragraphs that is of a durable metal construction and is virtually impervious to the elements.

DETAILED DESCRIPTION OF THE INVENTION

Figure 1:
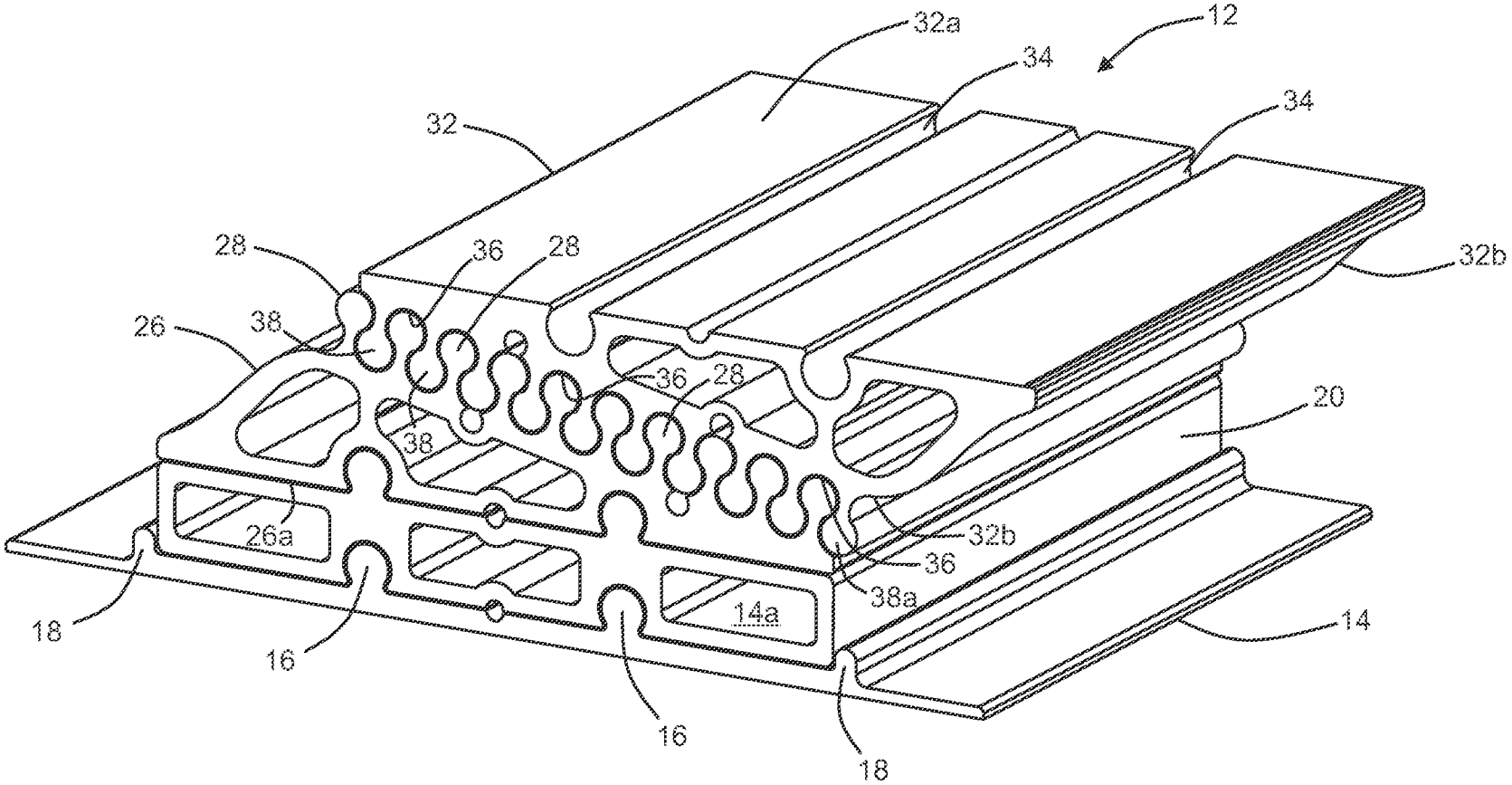
FIG. 1 is a generally perspective view of one form of the shim assembly of the invention.
Figure 2:
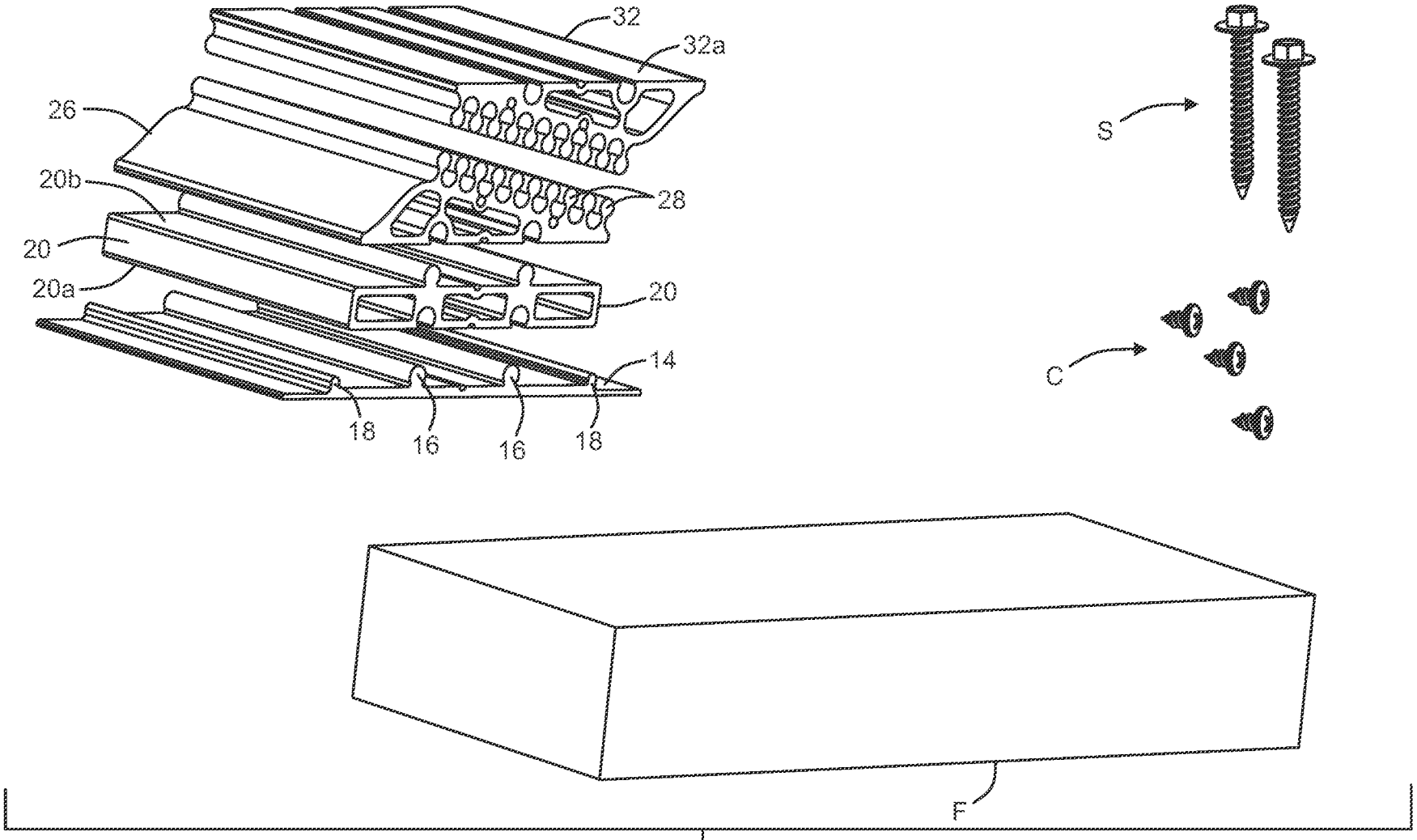
FIG. 2 is a generally perspective exploded view of the shim assembly illustrated in FIG. 1 when positioned proximate a portion of a frame opening.
Figure 3:
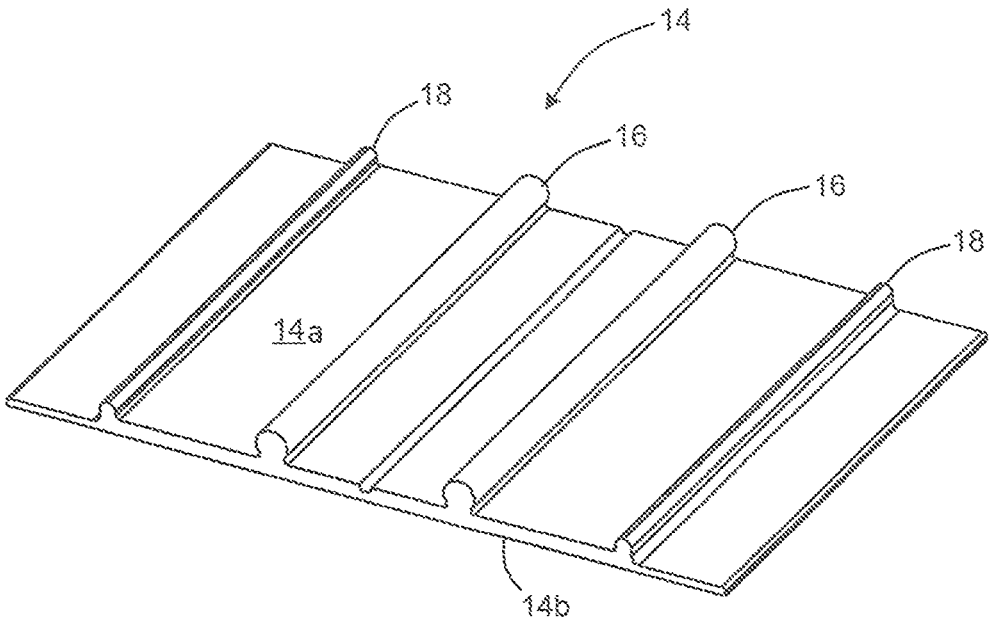
FIG. 3 is a generally perspective top view of the base of the shim assembly illustrated in FIG. 1.
Figure 4:
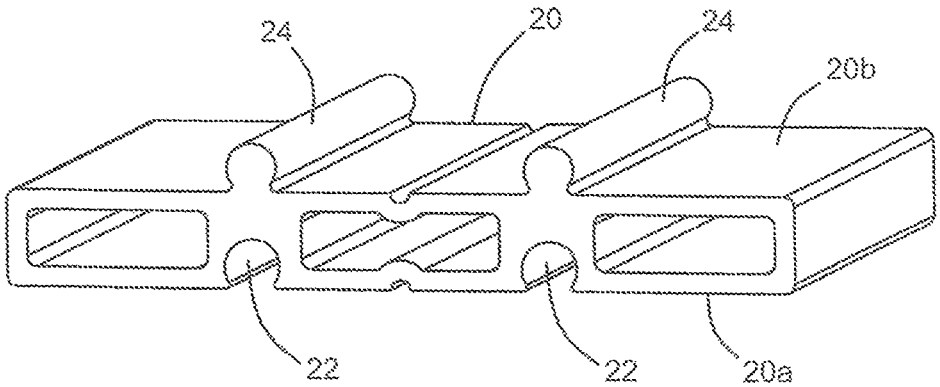
FIG. 4 is a generally perspective top view of the base extension of the shim assembly illustrated in FIG. 1.
Figure 5:
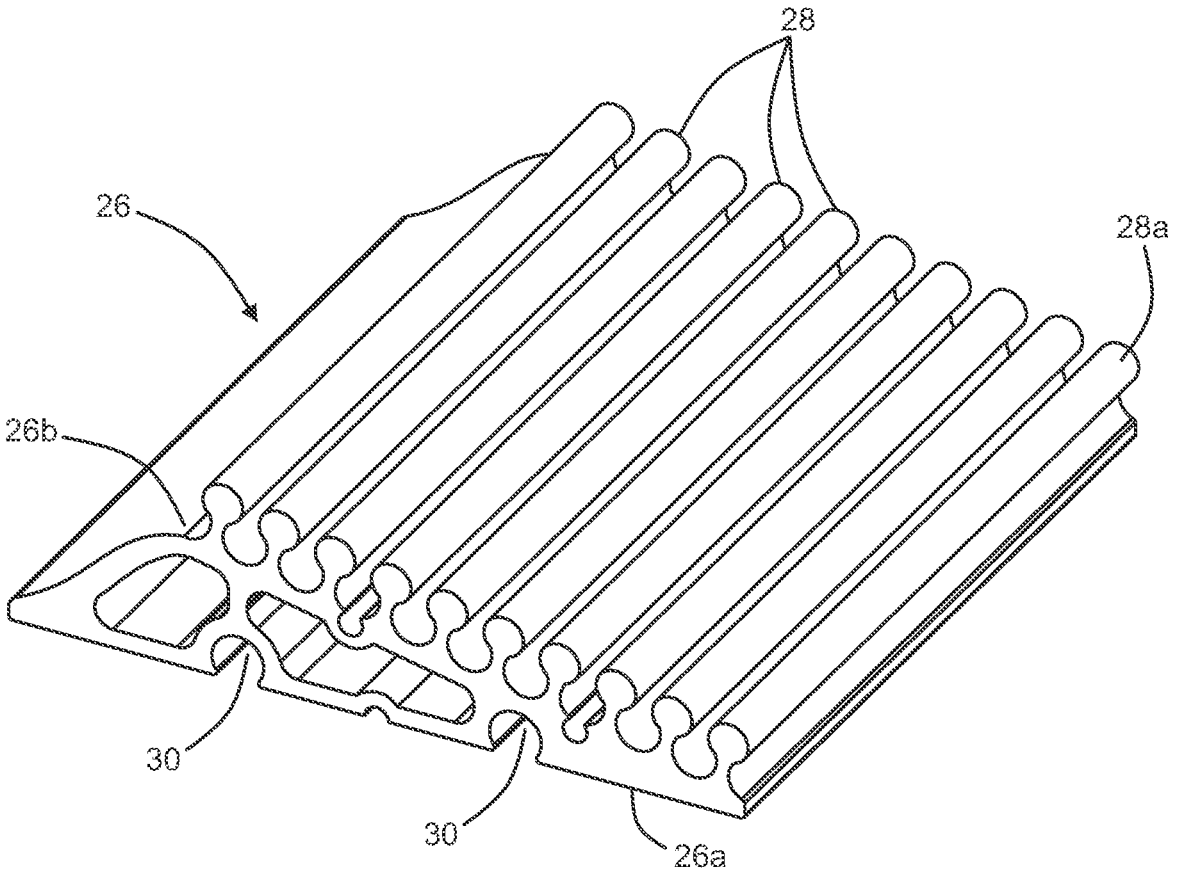
FIG. 5 is a generally perspective top view of the fixed wedge component of the shim assembly illustrated in FIG. 1.
Figure 6:
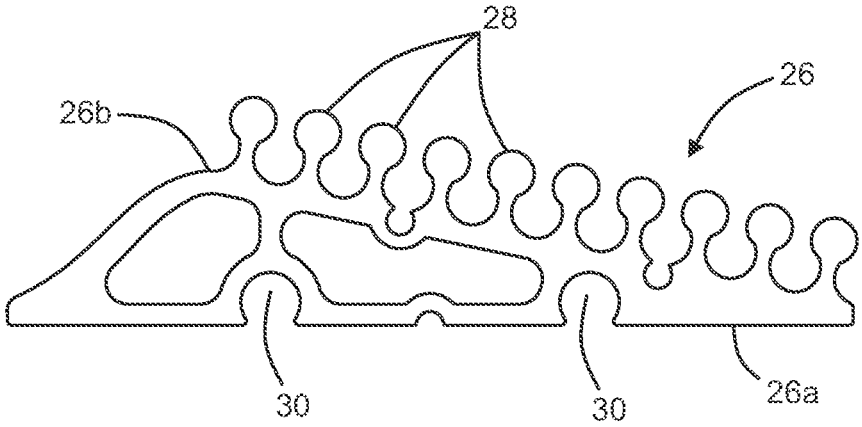
FIG. 6 is a side elevational view of the fixed wedge component of the shim assembly shown in FIG. 5.
Figure 7:
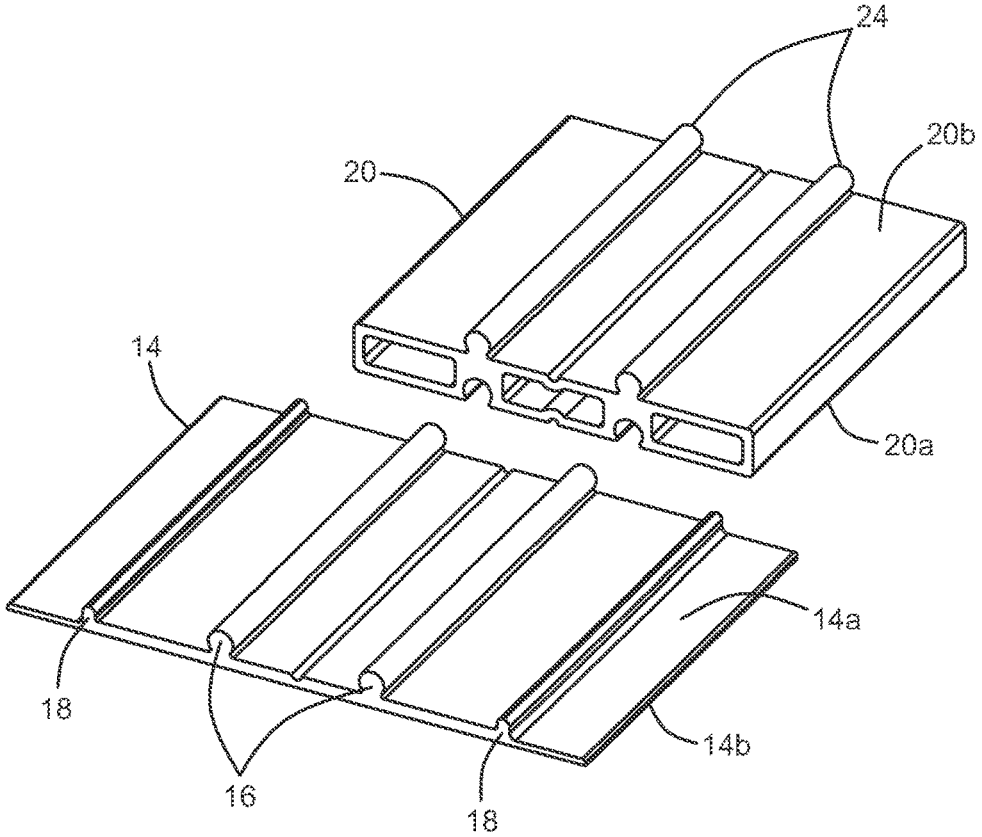
FIG. 7 is a generally perspective, exploded view illustrating the manner of slidably interconnecting the base extension component with the base of the shim assembly.
Figure 8:
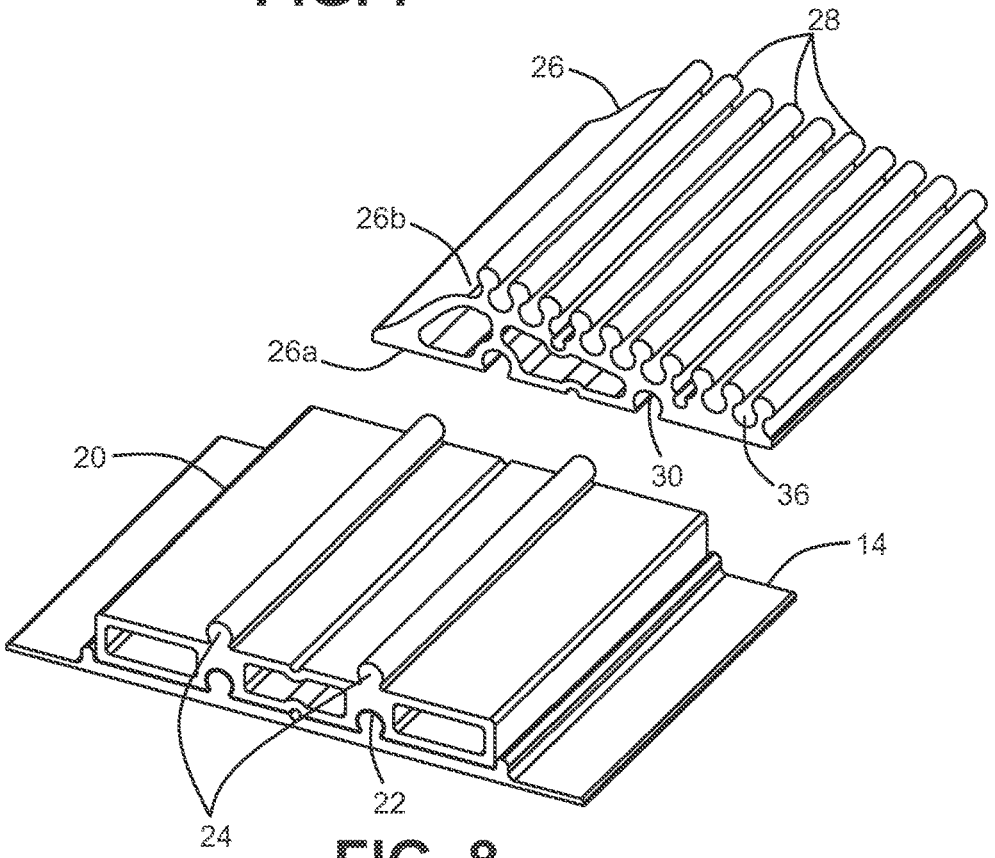
FIG. 8 is a generally perspective, exploded view illustrating the manner of slidably interconnecting the fixed wedge component with the base extension of the shim assembly.
Figure 9:
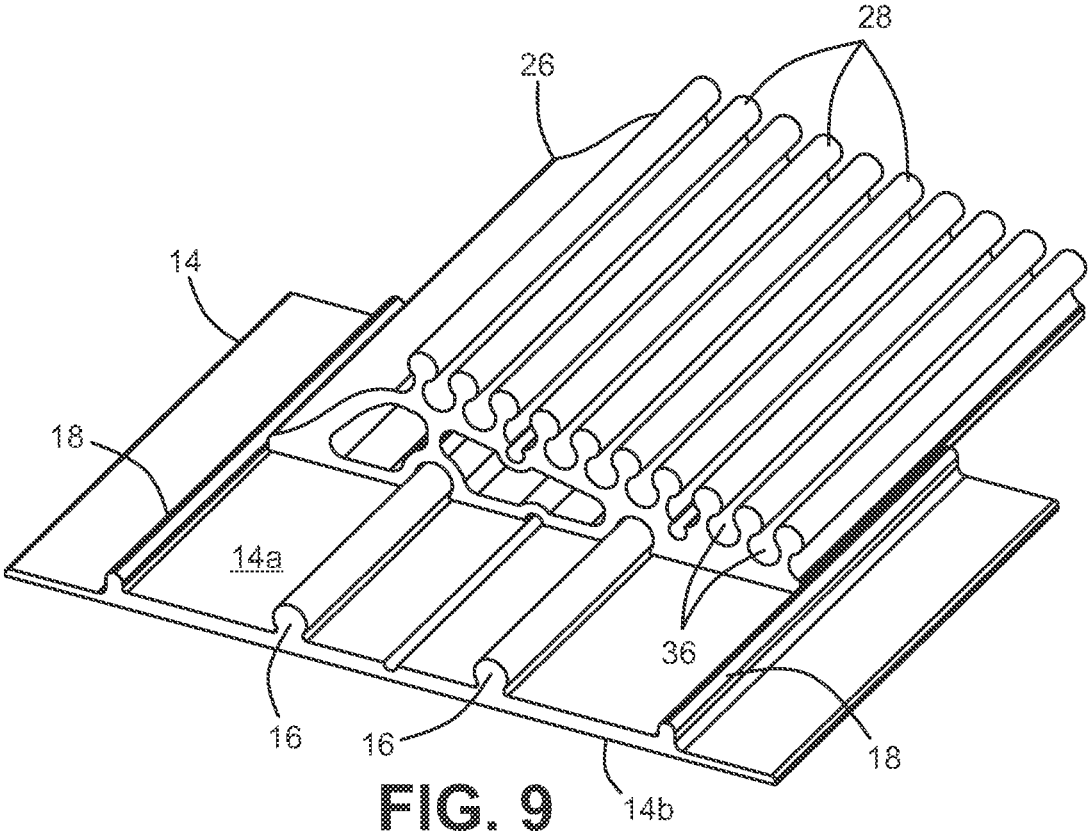
FIG. 9 is a generally perspective, exploded view illustrating the manner of slidably interconnecting the fixed wedge component with the base of the shim assembly.
Figure 10:
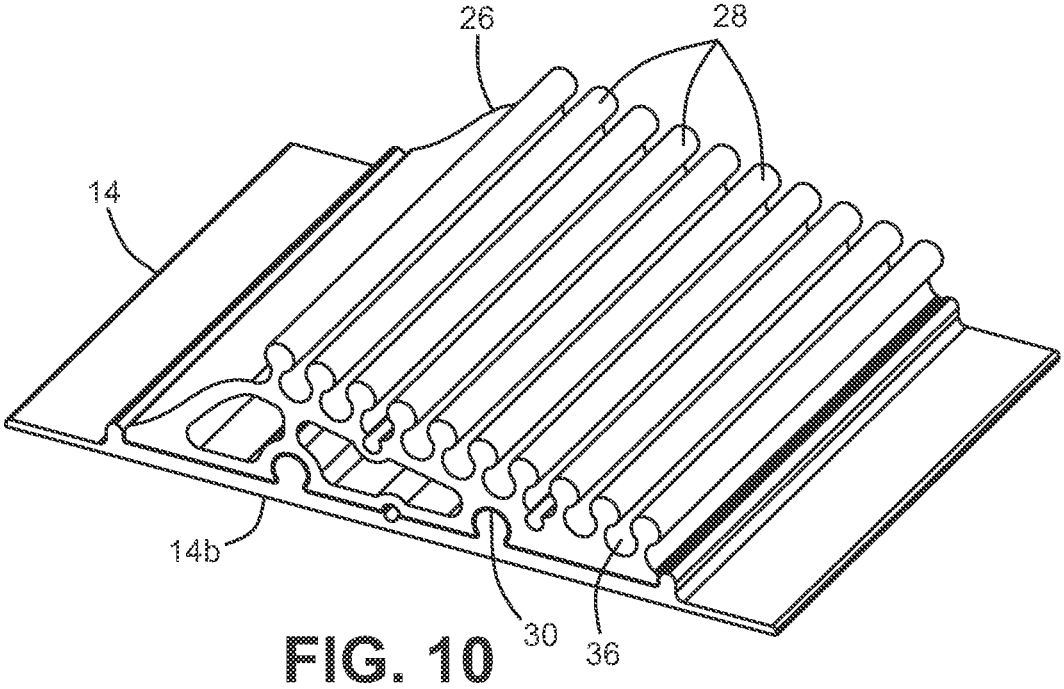
FIG. 10 is a generally perspective view illustrating the fixed wedge component as it appears when operably interconnected with the base of the shim assembly.

Referring to the drawings and particularly to FIGS. 1 and 2, one form of the present invention can be seen to comprise an adjustable shim assembly generally designated by the numeral 12. Assembly 12 here comprises a rectangular shaped rigid base 14 of substantially uniform thickness, said base having a flat upper surface 14*a* and a flat uninterrupted_lower surface 14*b* (see FIG. 3), said upper surface overlaying and extending substantially parallel to said lower surface. Provided on upper surface 14*a* is a plurality of spaced apart base rails 16 and a plurality of spaced apart guides 18. Slidably connected to base 14 for movement between a first position and a second position is a base extension 20 that has a lower surface 20*a* and an upper surface 20*b*, Lower surface 20*a* is provided with a plurality of spaced apart track like channels 22 and upper surface 20*b* is provided with a plurality of spaced apart base extension rails 24 (FIG. 4). Slidably connected to base extension 20 for movement between a first position to a second position is a rectangular shaped first, or fixed wedge 26. As best seen in FIGS. 5 and 6 of the drawings, fixed wedge 26 has a flat lower surface 26*a* extending substantially parallel to the lower surface of the base and a downwardly sloping upper surface 26*b* that is provided with a plurality of spaced apart fixed wedge rails 28. Lower surface 26*b* is provided with a plurality of track like channels 30 that are configured and arranged to encircle and strategically engage the base extension rails 24 (FIG. 5). Slidably connected to fixed wedge 26 for movement between a first position and a second position is a rectangular shaped second, or adjustable wedge 32. Second wedge 32 has an upper surface 32*a* provided with spaced apart track like channels 34 and a downwardly sloping lower surface 32*b* provided with a multiplicity of spaced apart track like channels 36 that are configured to encircle and strategically engage fixed wedge rails 28. Lower surface 32*b* of adjustable wedge 32 is also provided with a multiplicity of spaced apart rails 38 (FIG. 1).

Figure 11:
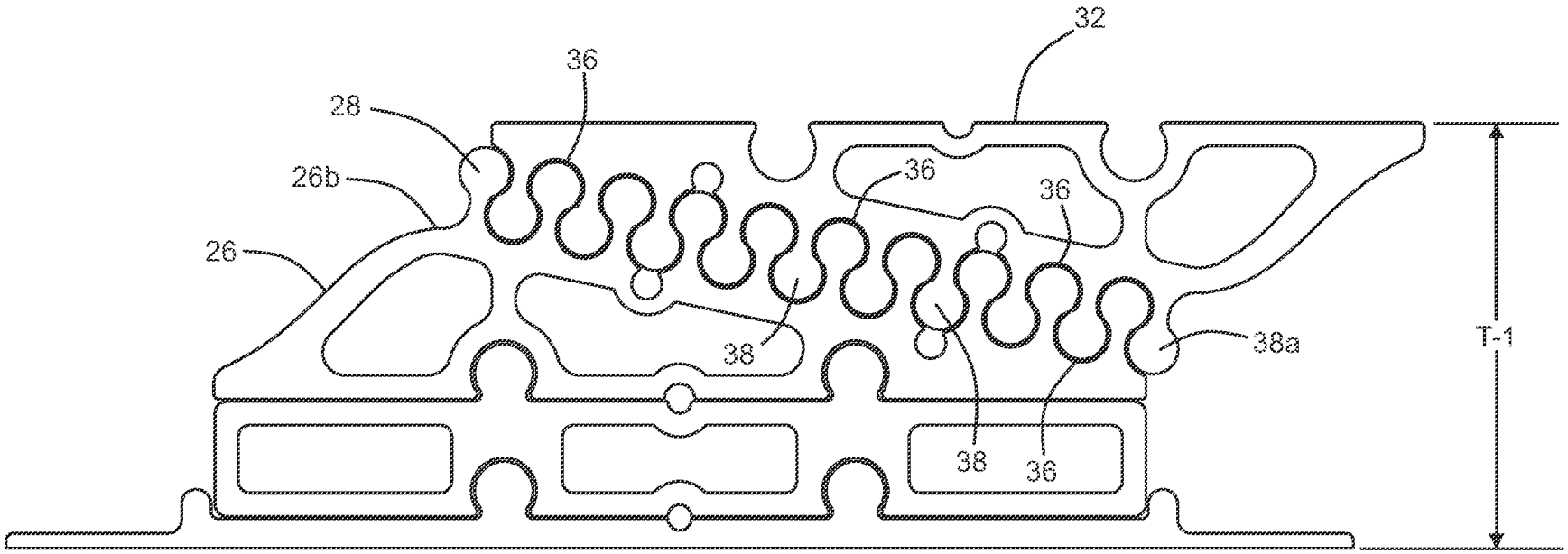
FIG. 11 is a side view illustrating the adjustable wedge component as it appears when operably interconnected with the fixed wedge component of the shim assembly.
Figure 11A:
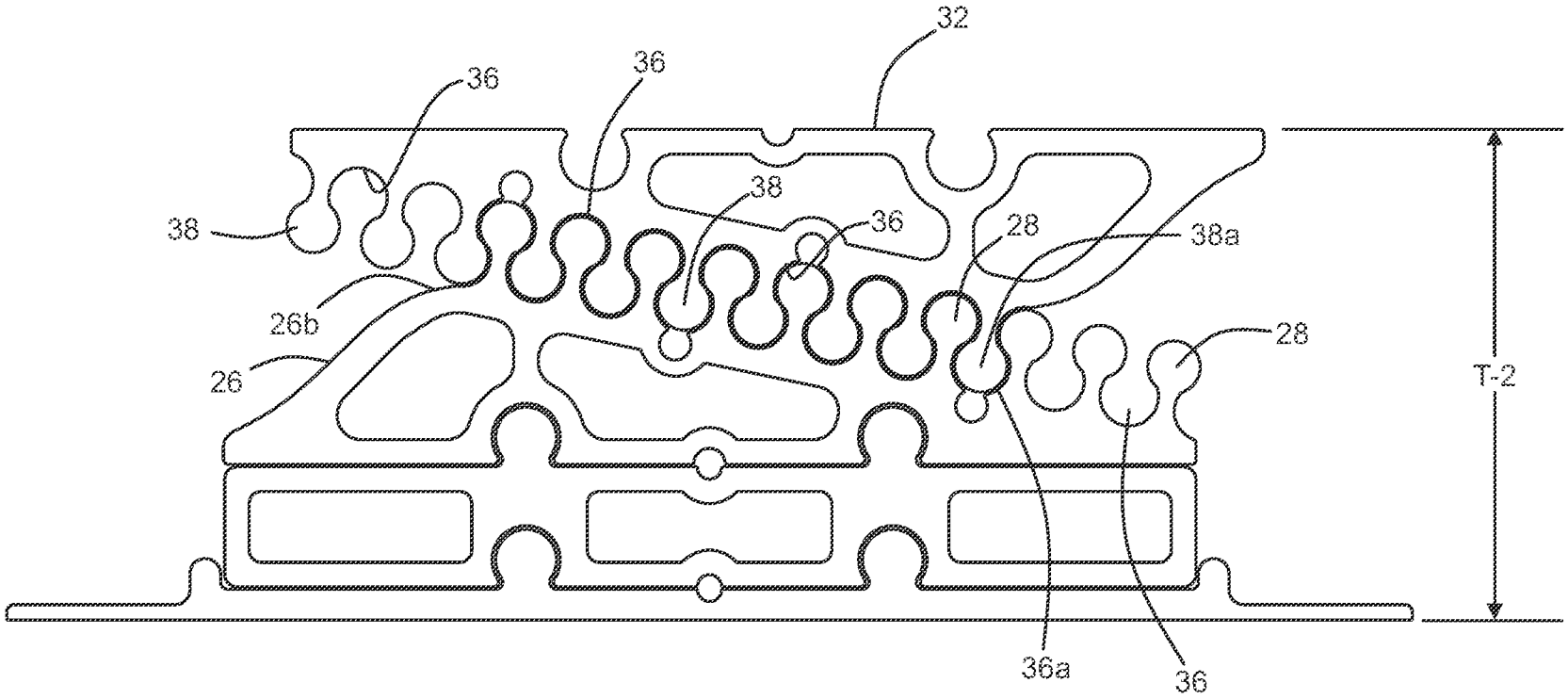
FIG. 11A is a generally side view similar to FIG. 11 illustrating the adjustable wedge component as it appears when in an advanced position relative to the fixed wedge component of the shim assembly.
Figure 11B:
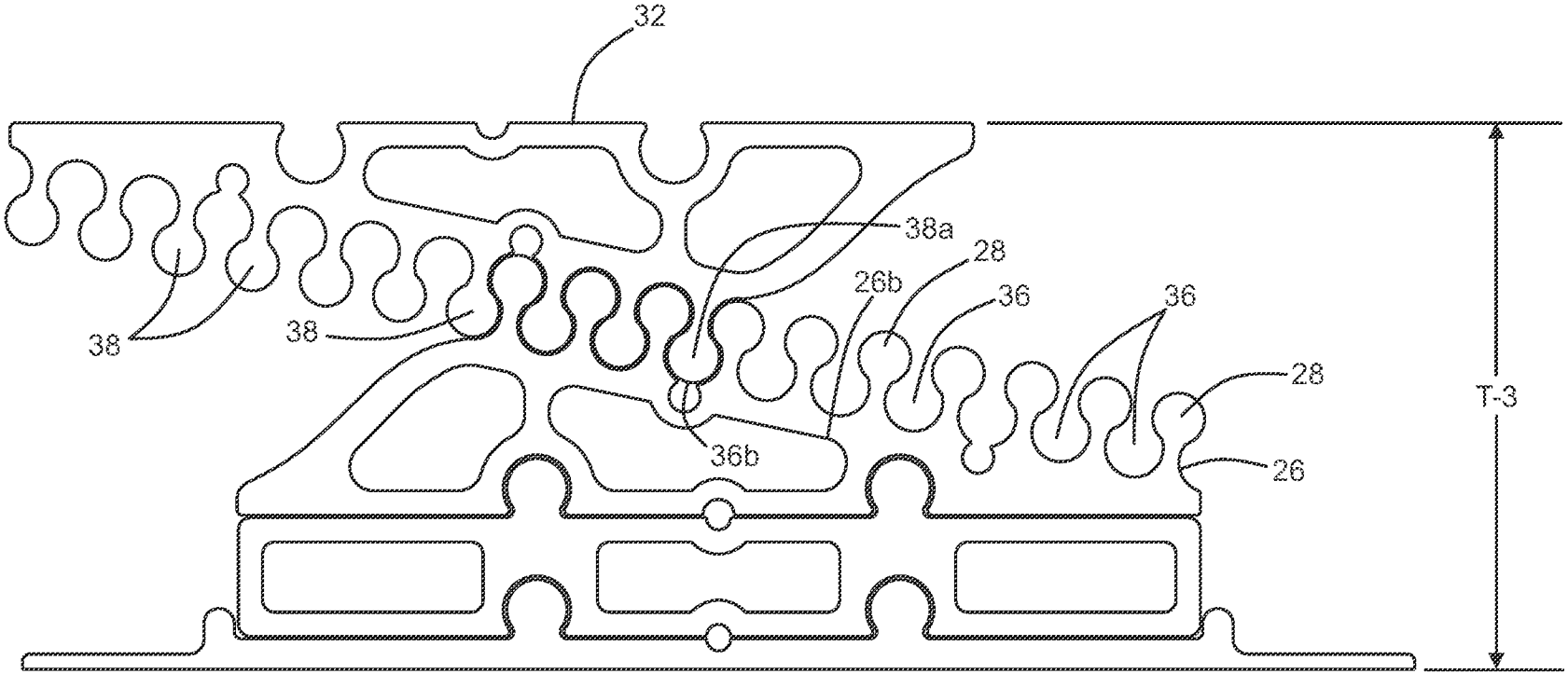
FIG. 11B is a view similar to FIG. 11A illustrating the adjustable wedge component as it appears in a further advanced position relative to the fixed wedge component of the shim assembly.

Referring to FIGS. 11, 11A and 11B, one method of the invention for incrementally adjusting the thickness of the shim assembly is there illustrated. FIG. 11 illustrates the starting position of the shim assembly wherein the thickness of the assembly is designated as "T−1". FIG. 11A illustrates an adjustment of the shim assembly in a manner to increase the thickness of the shim to "T−2". This adjustment is accomplished by slidably removing the adjustable wedge 32 from the fixed wedge 26 and then repositioning the adjustable wedge by slidably interconnecting it to the fixed wedge at a location upwardly of the sloping surface 26*b*. More particularly, in this position the rail designated as 38*a* in FIG. 11 is moved from the position shown in FIG. 11 to the position shown in FIG. 11A wherein it is received within the channel designated as 36*a*. FIG. 11B illustrates a further adjustment of the shim assembly in a manner to increase its thickness to "T−3". This adjustment is accomplished by once again slidably removing the adjustable wedge 32 from the fixed wedge 26 and then reconnecting it to the fixed wedge at a location further upwardly of the sloping surface 26*b*. More particularly, in this position the rail designated as 38*a* in FIG. 11 is moved from the position shown in FIG. 11A to the position shown in FIG. 11B wherein it is received within the channel designated as 36*b*. It is to be understood that the starting thickness T−1 can be varies depending upon the work to be accomplished. Similarly, the integrals of adjustment of the thickness of the shim assembly can be varied depending on the work to be accomplished. However, experience has shown adjustment of the thickness of the shim assembly by increments of 1/16 of an inch has proven satisfactory for most undertakings.

In in accordance with one method of the invention for adjusting distances between an exterior frame of an insertable structure and an opening frame of a building, at least two of the shim assemblies of the invention are placed upon spaced apart portions of the bottom of the opening frame "F" (FIG. 2). Next, a level is placed across the shim assemblies to determine which of the shim assemblies must be adjusted to level the insertable structure. Once this is determined, and after the appropriate threaded connectors "C" (FIG. 2) that function to interconnect the various components of the shim assembly have been removed, the adjustable wedge 32 of the selected shim assembly is slidably removed from fixed wedge 26 of the selected shim assembly. This done, the adjustable wedge is slidably reconnected to the fixed wedge at a location spaced apart from the starting position shown in FIG. 11 where the shim thickness is "T−1", to an advanced position such as the position shown in FIG. 11A where the shim thickness is increased to "T−2". Using appropriate connectors, such as screws "S" (FIG. 2), the pairs of shims are then secured to the sill.

In a similar manner, at least two of the shim assemblies of the invention are placed upon spaced apart portions of the opposed vertical sides of the opening frame of the structure as well as upon spaced apart portions of the top of the opening frame. Typically, the shims are inserted from opposing sides of the insertable structure and held in place temporarily by friction between side and top structural surfaces of the opening frame of the building and the exterior frame of the window or door. Next, the thickness of the shims is adjusted incrementally in the manner described in the preceding paragraphs to change the thickness of the shims as necessary to bring the insertable structure into plumb. More particularly, in order to change the thickness of a given shim, the adjustable wedge 32 of the shim is slidably removed from fixed wedge 26 and appropriately repositioned on the fixed shim in the manner previously described. When the shim assemblies are adjusted so that the insertable structure is plumb and square, the shims are secured, such as by screws "S" (FIG. 2), to the frame structure of the opening frame.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. An adjustable shim assembly comprising:

(a) a rigid rectangular shaped base of substantially uniform thickness, said base having a flat, uninterrupted lower surface and a flat upper surface overlying and extending substantially parallel to said lower surface of said base, said upper surface having a plurality of spaced apart base rails;

(b) a rectangular shaped first wedge connected to said base, said first wedge having a flat lower surface extending substantially parallel to said lower surface of base, said first wedge being provided with a multiplicity of spaced apart wedge rails; and (c) a rectangular shaped second wedge connected to said first wedge for movement between a first position and a second position, said second wedge having a surface provided with a multiplicity of spaced apart channels that are configured to engage the multiplicity of spaced apart wedge rails.

2. The adjustable shim assembly as defined in claim 1 in which said first wedge includes a surface having a plurality of spaced apart channels.

3. The adjustable shim assembly as defined in claim 1 further including a base extension slidably connected to said base for movement between a first position to a second position.

4. The adjustable shim assembly as defined in claim 3 in which said base extension has an upper surface provided with a plurality of spaced apart rails.

5. The adjustable shim assembly as defined in claim 4 in which said base extension has a lower surface provided with a plurality of spaced apart channels.

6. An adjustable shim assembly comprising:

(a) a rigid rectangular shaped base of substantially uniform thickness, said base having a flat, uninterrupted lower surface and a flat upper surface overlaying and extending substantially parallel to said lower surface of said base, said upper surface having a plurality of spaced apart base rails;

(b) a rectangular shaped fixed wedge connected to said base, said fixed wedge having a downwardly sloping upper surface provided with a multiplicity of spaced apart fixed wedge rails; and (c) an adjustable rectangular shaped wedge connected to said fixed wedge for movement between a first position and a second position, said adjustable wedge having an upwardly sloping lower surface provided with a multiplicity of spaced apart track like channels that are configured to encircle and engage said multiplicity of spaced apart fixed wedge rails.

7. The adjustable shim assembly as defined in claim 6 in which said fixed wedge includes a lower surface having a plurality of spaced apart track like channels.

8. The adjustable shim assembly as defined in claim 6 further including a base extension slidably connected to said base for movement between a first position to a second position.

9. The adjustable shim assembly as defined in claim 8 in which said base extension has an upper surface provided with a plurality of spaced apart rails and a lower surface provided with a plurality of spaced apart track like channels.

10. An adjustable shim assembly comprising;

(a) a rigid rectangular shaped base of substantially uniform thickness, said base having a flat, uninterrupted lower surface and a flat upper surface overlaying and extending substantially parallel to said lower surface of said base, said upper surface having a plurality of spaced apart base rails;

(b) a base extension connected to said base, said base extension having a plurality of spaced apart track like channels configured to encircle and engage said base rails;

(c) a rectangular shaped fixed wedge connected to said base extension, said fixed wedge having an angularly extending upper surface provided with a multiplicity of spaced apart fixed wedge rails; and (d) an adjustable rectangular shaped wedge connected to said fixed wedge, said adjustable wedge having an upper surface and an angularly extending lower surface provided with a multiplicity of spaced apart track like channels constructed and arranged to encircle and engage said fixed wedge rails.

11. The adjustable shim assembly as defined in claim 10 in which said base has an upper surface provided with a plurality of spaced apart guides constructed and arranged to engage said base extension.

12. The adjustable shim assembly as defined in claim 10 in which said fixed wedge is slidably connected to said base extension for movement between a first position to a second position.

13. The adjustable shim assembly as defined in claim 10 in which said upper surface of said adjustable wedge is provided with a plurality of spaced apart track like channels.

14. An adjustable shim assembly comprising:

(a) a rigid rectangular shaped base of substantially uniform thickness, said base having a flat, uninterrupted lower surface and a flat upper surface overlaying and extending substantially parallel to said lower surface of said base, said upper surface having a plurality of spaced apart base rails;

(b) a base extension slidably connected to said base for movement between a first position to a second position, said base extension having a lower surface provided with a plurality of spaced apart track like channels configured to encircle and engage said base rails and an upper surface provided with a plurality of spaced apart base extension rails;

(c) a rectangular shaped fixed wedge slidably connected to said base extension for movement between a first position to a second position, said fixed wedge having a lower surface provided with a plurality of spaced apart track like channels configured to encircle and engage said base extension rails and a downwardly sloping upper surface provided with a multiplicity of spaced apart fixed wedge rails; and (d) a rectangular shaped adjustable wedge connected to said fixed wedge for movement between a first position and a second position, said adjustable wedge having an upwardly sloping lower surface provided with a multiplicity of spaced apart track like channels configured to encircle and engage said fixed wedge rails and an upper surface provided with a plurality of tracks.

15. The adjustable shim assembly as defined in claim 14 in which said upper surface of said base has a plurality of spaced apart guides provided thereon.

* * * * *